US006055781A

United States Patent [19]

Johanson

[11] Patent Number: 6,055,781

[45] Date of Patent: May 2, 2000

[54] ARCHBREAKING HOPPER FOR BULK SOLIDS

[75] Inventor: Jerry R. Johanson, San Luis Obispo, Calif.

[73] Assignee: JR Johanson, Inc., San Luis Obispo, Calif.

[21] Appl. No.: 08/963,528

[22] Filed: Nov. 3, 1997

Related U.S. Application Data

[60] Provisional application No. 60/030,321, Nov. 4, 1996.

[51] Int. Cl.[7] ..... B65D 88/28; B65D 88/64

[52] U.S. Cl. ..... 52/197; 52/192; 222/185.1; 222/462

[58] Field of Search ..... 52/192, 195, 197; 222/185.1, 462

[56] References Cited

U.S. PATENT DOCUMENTS

| | | | |
|---|---|---|---|
| 2,943,752 | 7/1960 | Platt | 52/197 X |
| 3,071,297 | 1/1963 | Lee | 222/462 |
| 3,593,892 | 7/1971 | Petit | 52/197 X |
| 3,712,002 | 1/1973 | Hillinger et al. | 52/197 X |
| 3,797,707 | 3/1974 | Jenike et al. | 222/462 X |
| 4,286,883 | 9/1981 | Johanson | 366/137 |
| 4,702,364 | 10/1987 | Johanneck | 52/197 X |

*Primary Examiner*—Carl D. Friedman
*Assistant Examiner*—Kevin D. Wilkens
*Attorney, Agent, or Firm*—Daniel C. McKown

[57] ABSTRACT

A hopper that greatly reduces the tendency of the particulate material to form bridges within the hopper is shaped so that its walls slope downward more steeply at the bottom of the hopper and slope less steeply with increasing height above the outlet. In one embodiment the slope decreases continuously with increasing height above the outlet. In another embodiment the hopper is formed of successive sections, each joined around its circumference to the next-lower section, the wall of each section being less steeply inclined than the wall of the adjoining next-lower section. Exact relationships are given, relating the slopes of successive sections, and if the hopper is built in conformity with these relationships, arching of the particulate material is eliminated.

6 Claims, 11 Drawing Sheets

ARCHBREAKING HOPPER FOR BULK SOLIDS

CROSS REFERENCE TO RELATED APPLICATIONS

This application claims the benefit of U.S. Provisional Application Ser. No. 60/030321 filed Nov. 4, 1996.

BACKGROUND OF THE INVENTION

One of the most common problems with bulk solids such as coal, sugar, flour and other various chemicals is arching or bridging at the outlet of a converging hopper. The usual solutions for eliminating bridges include enlarging the outlet beyond the critical size for bridging, and using physical agitation such as air blasters, vibrators, air lances and poke bars to dislodge the solids. While physical agitation works to some extent when arching occurs only after time at rest, the only effective way presently to handle a bulk solid that arches instantly when placed in a hopper is to enlarge the outlet size. This increases the size and cost of the feed device required below the outlet.

BRIEF SUMMARY OF THE INVENTION

An objective of the present invention is to provide a hopper that greatly reduces the tendency of the particulate material to form bridges within the hopper.

In accordance with the present invention this is accomplished by shaping the hopper so that its walls slope downward more steeply at the bottom of the hopper and slope less steeply the higher they are above the outlet.

In a first preferred embodiment the slope decreases continuously with increasing height above the outlet, whereby the profile of the wall is a smooth curve, and the wall of the hopper flares upward from the outlet, like an upwardly directed trumpet. In a second preferred embodiment, which reflects contemporary construction techniques, the hopper is formed of successive sections, each joined around its circumference to the next-lower section, the wall of each section being less steeply inclined than the wall of the adjoining next-lower section.

The present inventor has developed exact relationships between the slopes of successive sections. If the hopper is built in conformity with these relationships, arching of the particulate material is eliminated.

The present inventor has found that when the hopper is shaped consistent with the above scheme, the cross section of the hopper in a horizontal plane may have any of the commonly used shapes, such as circular, rectangular, and race track shaped. Examples of these are shown in the drawings.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE INVENTION

Figure 1:
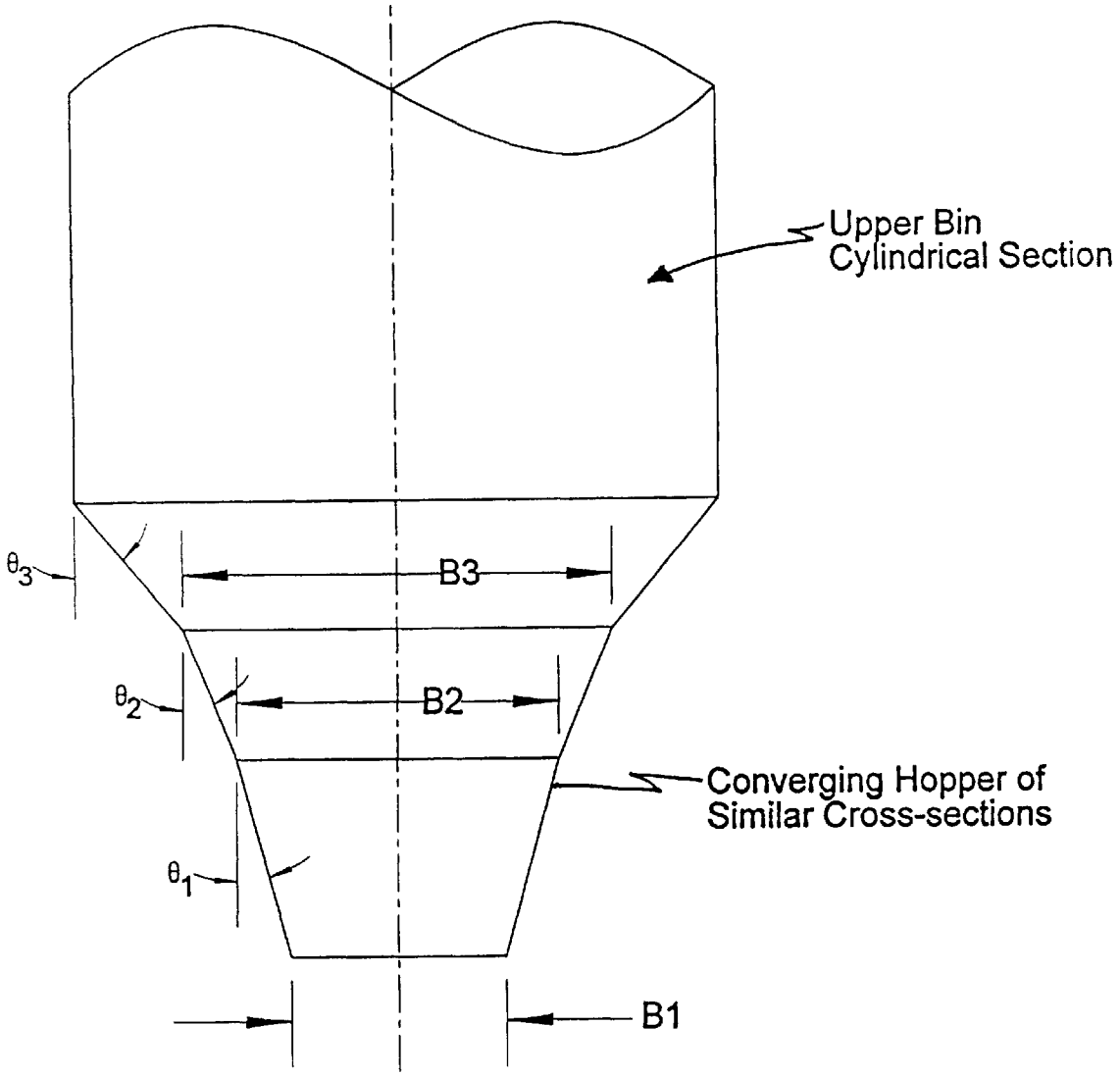
FIG. 1 is a diagram showing a side elevational view of a converging hopper having similar cross sections at all heights and defining some of the symbols used in the description.
Figure 2:
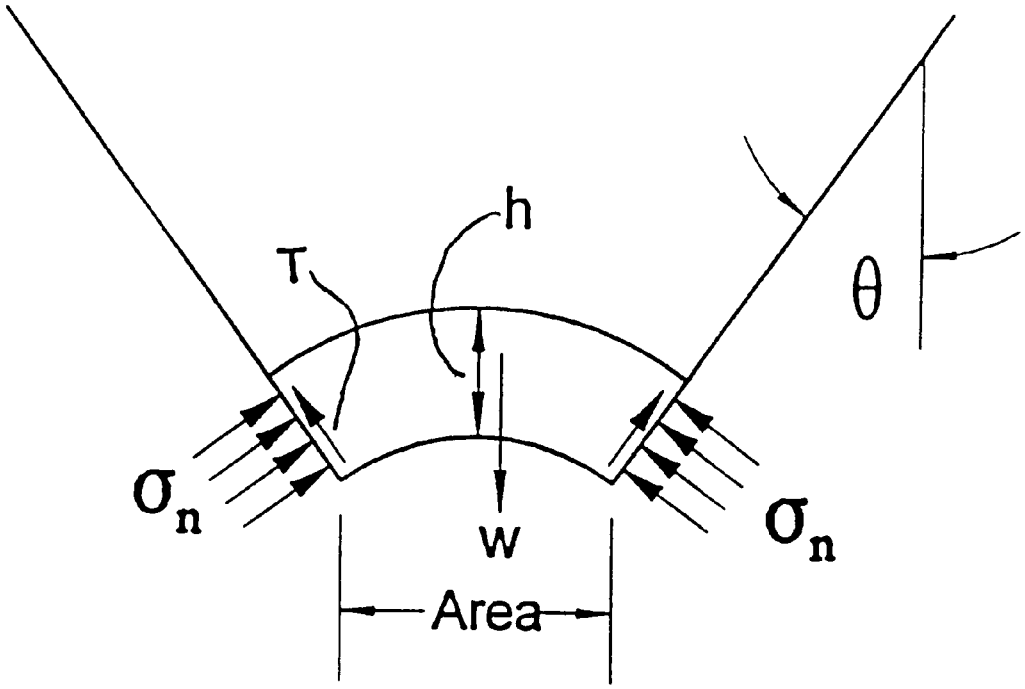
FIG. 2 is a diagram illustrating the concept of a self-supporting arch.

In its simplest form the invention is a converging hopper with a similar cross section throughout and with a variable slope angle starting with a steep angle at the outlet and progressing to a flatter angle toward the top (as shown in FIG. 1). The steeper angle at the bottom decreases the arching potential of the hopper when the cross section is the smallest. At a higher level of the hopper, the cross section has increased, so the hopper slope can decrease and have the same or better anti-bridging capability as the outlet. For the walls to be effective in reducing bridging they must be smooth and slick enough to cause flow at them. The slick and smooth requirement varies somewhat with the geometry of the hopper and the height of solids in the vertical section. There is a relation between wall slope, wall friction coefficient and distance from the vertical walls that determines the hopper slopes to maintain flow at the walls and thus ensure the anti-bridging effects of the hopper walls. If the wall flow criterion is met, then the anti-bridging potential of a hopper outlet is determined by the support from the hopper of a self-supporting arch of thickness h (see FIG. 2). The weight W in the arch is supported by the vertical component of force for stress $\sigma_n$ perpendicular to the hopper walls and shear stress T acting opposite to flow at the hopper wall.

$$T=\mu\sigma_n$$

where $\mu$=coefficient of friction between the wall and the bulk solid.

In general, the hopper angle θ may vary about the periphery of the hopper. The cross sectional area will depend on the hopper geometry and $\sigma_n$ may change depending on the hopper geometry.

In its most general form, the arch equilibrium is expressed by $$\oint\sigma_n(\text{Tan }\theta+\mu)dp=\oint\gamma ydA \quad (1)$$

where γ is the bulk specific weight of the solid. The integral on the right is the downward force integrated over the cross sectional area, and the integral on the left is the upward force integrated around the periphery of the hopper.

If $\gamma$, $\theta$, and $\sigma_n$ are constant the integration produces $$\sigma_n(\text{Tan}\ \theta+\mu)P/A=y$$

Where P is the circumference of the hopper and A is the cross sectional area at a particular level of the hopper. Rearranging gives $$\sigma_n=(yA/P)/(\text{Tan}\ \theta+\mu)$$

Figure 3:
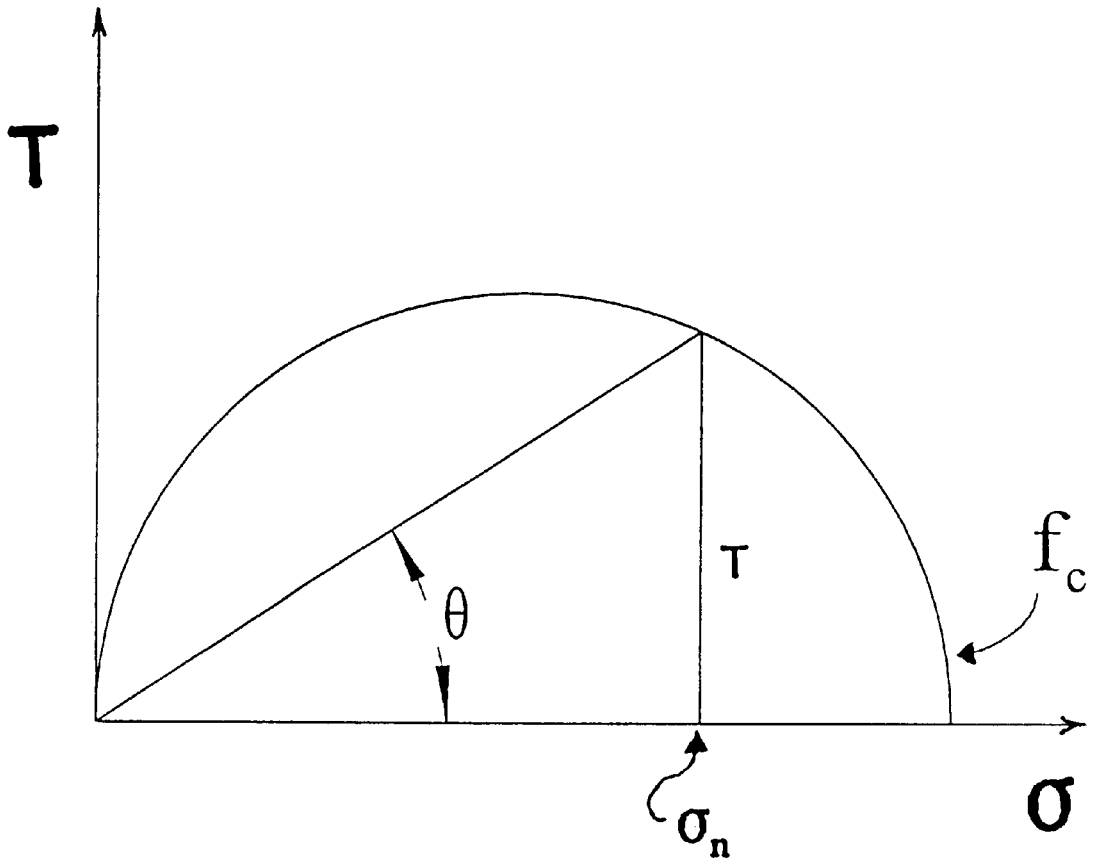
FIG. 3 is a diagram showing the relation between certain variables used in the description.

For arch failure to occur, the maximum major principal stress at the arch must exceed the unconfined yield stress $f_c$ of the solid in the arch. From Mohr circle geometry (see FIG. 3), $$\sigma_n=fc/(\mu^2+1) \quad (2)$$

$$\text{Tan}\ \theta=y(A/P)(\mu^2+1)/fc-\mu \quad (3)$$

For a conical hopper A/P=B/4 where B is the diameter of the cross section.

For a long slot hopper A/P=B/2 where B is the width of the cross section above which the failed arch was formed.

When the slot length exceeds three times the width, the end effect becomes negligible and the slot can be considered long.

Figure 4:
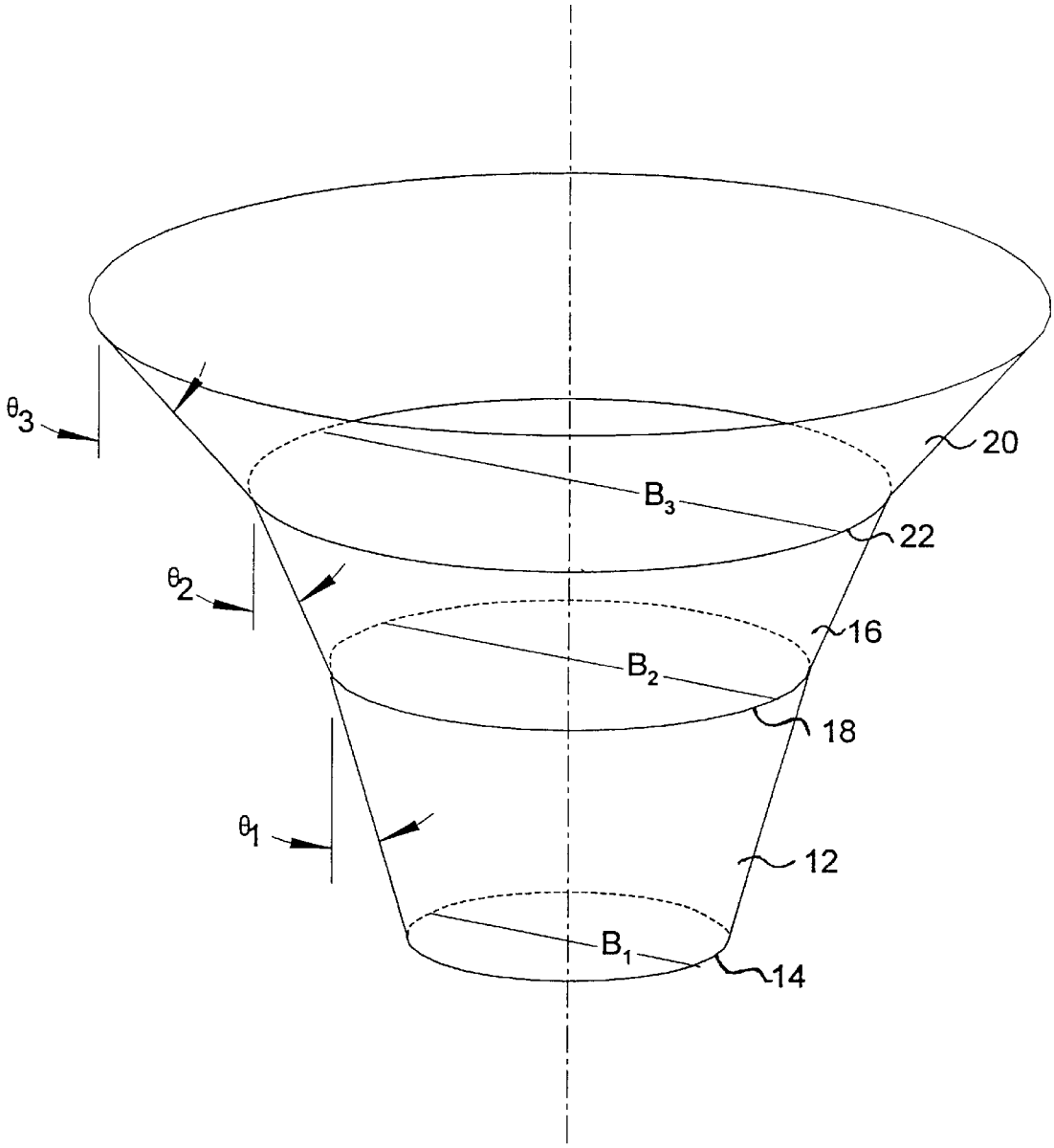
FIG. 4 is a diagram showing a right conical hopper in accordance with a preferred embodiment of the present invention.

In a theoretical sense one could use the above formula to generate a continuous optimum hopper shape; however, in a practical sense, the hopper is more likely to be constructed of segments, as in FIG. 4. The angle for each segment can be calculated as follows assuming that the lowest segment is designed for the critical arching of the bulk solid using the appropriate $f_c$ and that this $f_c$ is essentially constant for the remaining segments.

$$\text{Tan}\ \theta_2=(B_2/B_1)(\text{Tan}\ \theta_1+\mu)-\mu \quad (4)$$

where $\theta_1$ is the deviation of the hopper wall from vertical for the lowest segment 12, $B_1$ is the diameter of the discharge opening 14 of the lowest segment, $\theta_2$ is the deviation of the hopper wall from vertical for the next higher segment 16 and $B_2$ is the diameter of the discharge opening 18 of segment 16, $\theta_3$ is the deviation of the hopper wall from vertical for the third segment 20, and $B_3$ is the diameter of the discharge opening 22 of segment 20, and so on for any additional segments the hopper may, in general, include.

Figure 5:
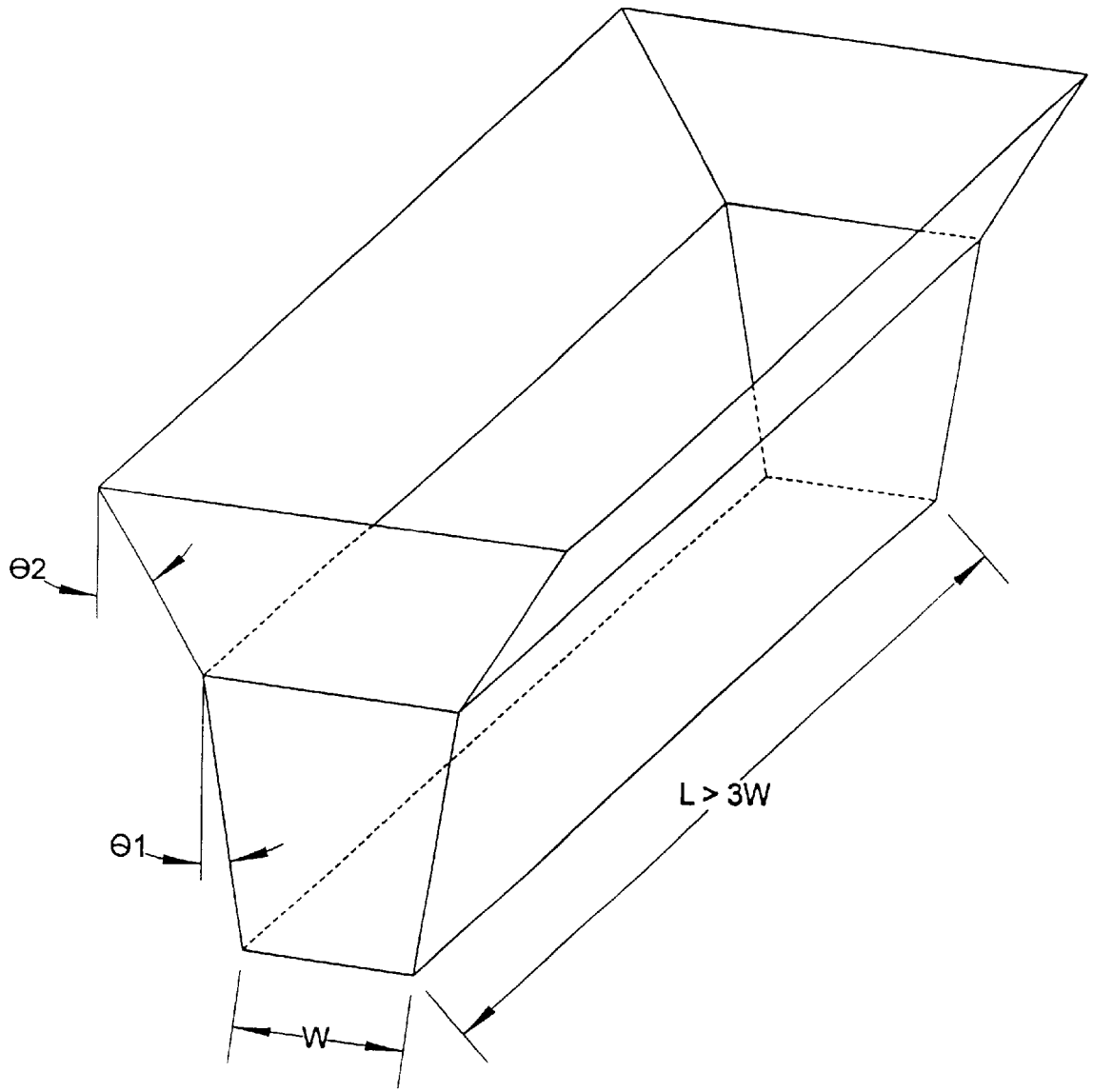
FIG. 5 is a diagram showing a wedge-shaped long slot hopper in accordance with the present invention.
Figure 7:
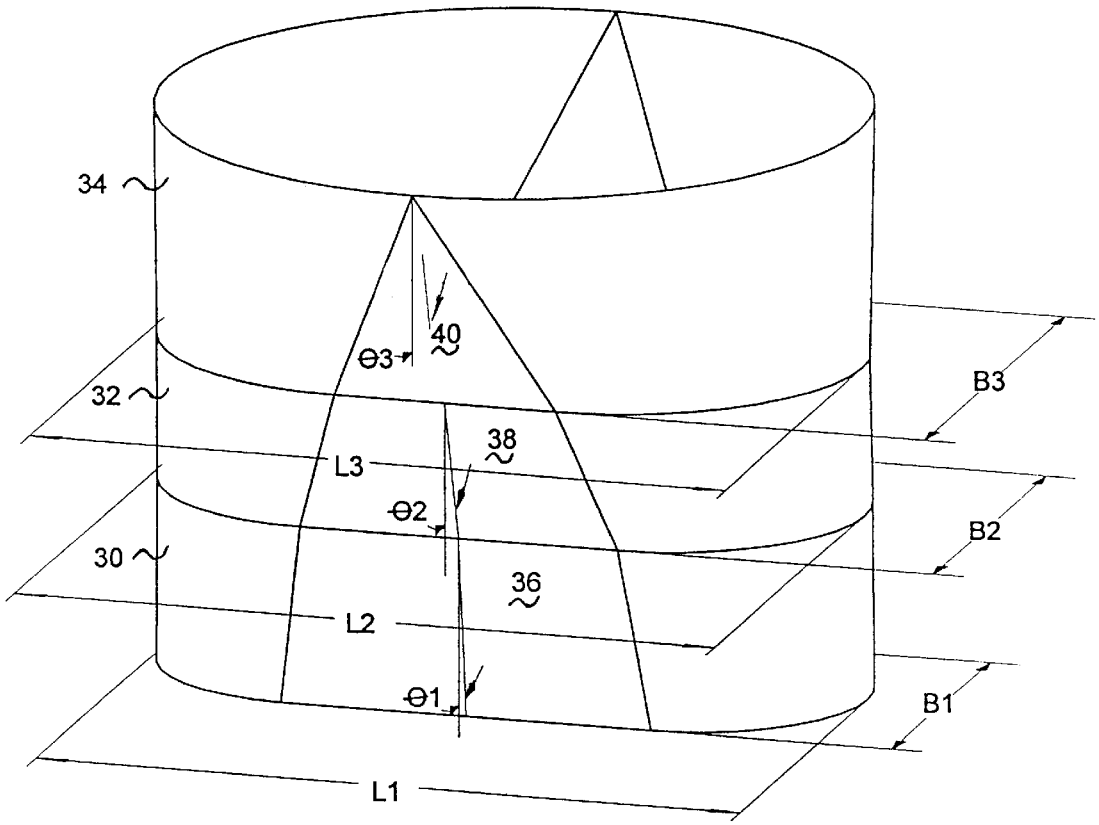
FIG. 7 is a diagram showing a type of chisel-shaped hopper in accordance with the present invention.

Equation (4) applies only to the right conical hopper of FIG. 4, to the wedge-shaped long slot hopper of FIG. 5, and to the chisel-shaped hopper of FIG. 7. A more exact method for these hoppers is to use Equation 3 with the appropriate value of $f_c$ used. In the most general sense $\sigma_n$ and $\theta$ vary around the periphery and the Mohr circle relation applies only to the maximum $\sigma_n$. Subsequent hopper slopes can then be calculated using Equation (1) with the prescribed variation of $\sigma_n$ and with Equation (2) used to define the maximum $\sigma_n$.

Figure 6:
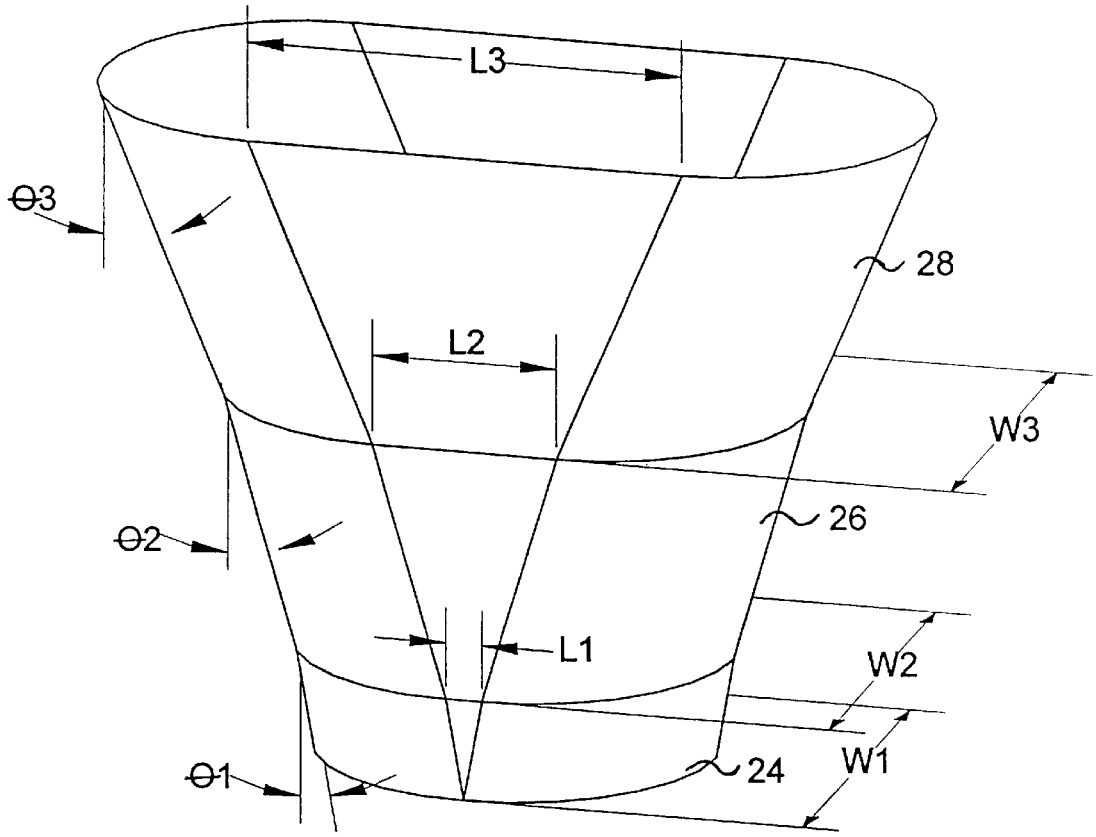
FIG. 6 is a diagram showing a one dimensional converging hopper in accordance with the present invention.

The basic invention of a variable hopper slope angle used to reduce the arching in a converging hopper of similar cross section works equally well with the one-dimensional convergence hopper shown in FIG. 6 (see U.S. Pat. Nos. 4,958,741 and 5,361,945), so called because it converges downwardly only in the left-to-right direction but does not converge in the front-to-back direction as viewed in FIG. 6. It may even diverge downwardly in the front-to-back direction. This hopper has a race track shaped cross section and its perimeter consists of two semicircular ends alternating with two straight line segments. The lengths of the straight line segments measured at the top of each of the successively higher hopper segments 24, 26 and 28 are denoted by $L_1$, $L_2$, and $L_3$. The diameter of the semicircular ends measured at the lower end of each segment are denoted respectively by $W_1$, $W_2$, and $W_3$. The angles of deviation from vertical of the hopper wall of each hopper segment measured at the left and right ends of each segment, where the deviation is greatest, are denoted respectively by $\theta_1$, $\theta_2$, and $\theta_3$. In the case where the flat side walls are slightly diverging, the flat side walls have a $\sigma_n$ roughly 0.05 times the $\sigma_n$ acting in the direction of the curved converging walls. Equation (1) can be approximated by $$\pi w\sigma_{n\ max}(0.342\ \text{Tan}\ \sigma+0.425\ \mu)+0.1\ \mu L\sigma_{n\ max}=y(\pi w^2/4+wL)$$

combining with Equation (2)

$$\text{Tan}\ \theta=(y(\pi w/4+L)(u^2+1)/(\pi f_c)-0.1\ \mu L(\pi w)-0.425\ \mu)/0.342 \quad (6)$$

This equation can be used, as Equation (4) was used, to define subsequent slope angles. Assuming $f_c$ and w are constant and $f_c$ is determined by the lowest hopper angle $\theta_1$, then the following relation exists between L/W and $\theta$ for each segment of the hopper:

$$L/w=0.342\pi(\text{Tan}\ \theta_1-\text{Tan}\ \theta)/(1.368\ \text{Tan}\ \theta_1+1.6\ \mu) \quad (7)$$

This equation can be used along with the relation $$\Delta h=\Delta L/(2\ \text{Tan}\ \theta)$$

which is evident from FIG. 6, to determine a continuous curve that optimizes the hopper shape and minimizes the hopper height while preventing arching.

For the chisel-shaped hopper of FIG. 7, the equivalent of Equation (6) is $$B=2(f_c/y)((0.683+L/_B)\text{Tan}\ \theta+(0.711+L/_B)\ \mu)/((\mu^2+1)(\pi/4+L/_B)) \quad (8)$$

for each segment of the hopper, where

B is the width of the opening at the bottom of a section,

L is the length of the opening at the bottom of that section, $\theta$ is the inclination of the flat portion of the section from the vertical, $\mu$ is the coefficient of friction between the wall and the bulk solid, $f_c$ is the unconfined yield stress of the material, $\gamma$ is the bulk specific weight of the material.

Just as Equation (7) was used to optimize the shape of the one-dimensional convergence hopper of FIG. 6, so also Equation (8) can be used to optimize the shape of the chisel-shaped hopper of FIG. 7. In FIG. 7 the successively higher segments 30, 32, 34 have a race-track shape, but unlike the hopper of FIG. 6, the diameters $B_1$, $B_2$, $B_3$ of the segments 30, 32 and 34 increase from the bottom to the top of the hopper. Therefore, the flat portions 36, 38, 40 are inclined from the vertical by the angles $\theta_1$, $\theta_2$, $\theta_3$. The longest dimension of each of the segments 30, 32 and 34, measured at the bottom of each segment, are denoted by $L_1$, $L_2$, and $L_3$, respectively.

The inventor has found that the slopes used in constructed hoppers can differ from the angles calculated by the above equations by as much as plus or minus 5 degrees without adversely affecting the performance of the hopper.

Figure 8:
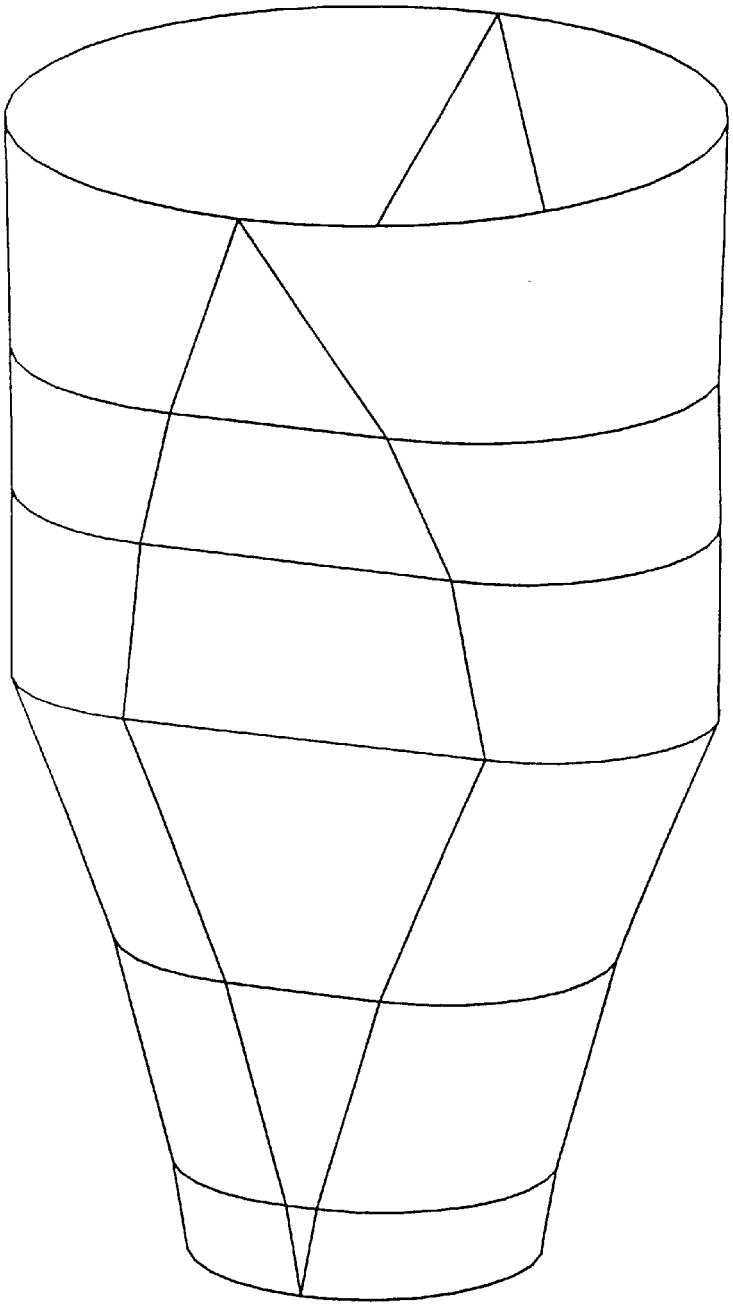
FIG. 8 is a diagram showing a combined chisel and one dimensional convergence hopper in accordance with the present invention.
Figure 9:
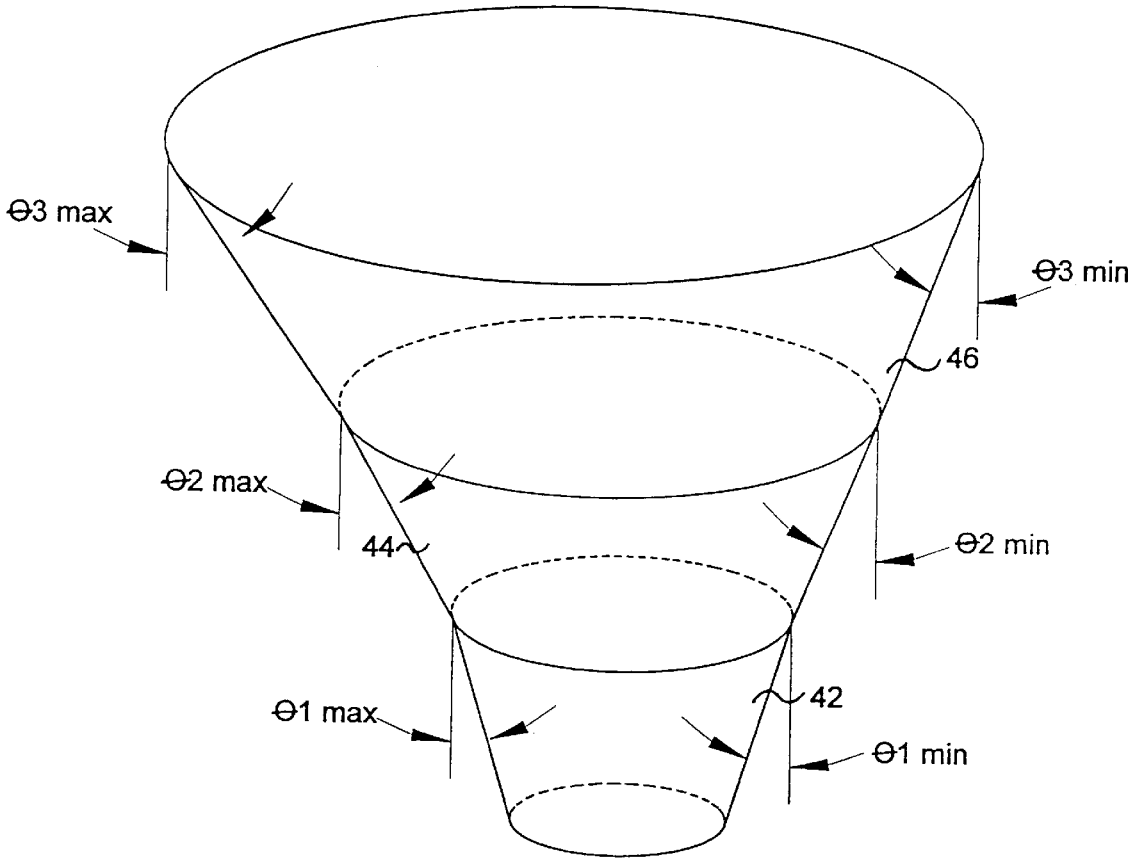
FIG. 9 is a diagram showing an offset conical hopper in accordance with the present invention.
Figure 10:
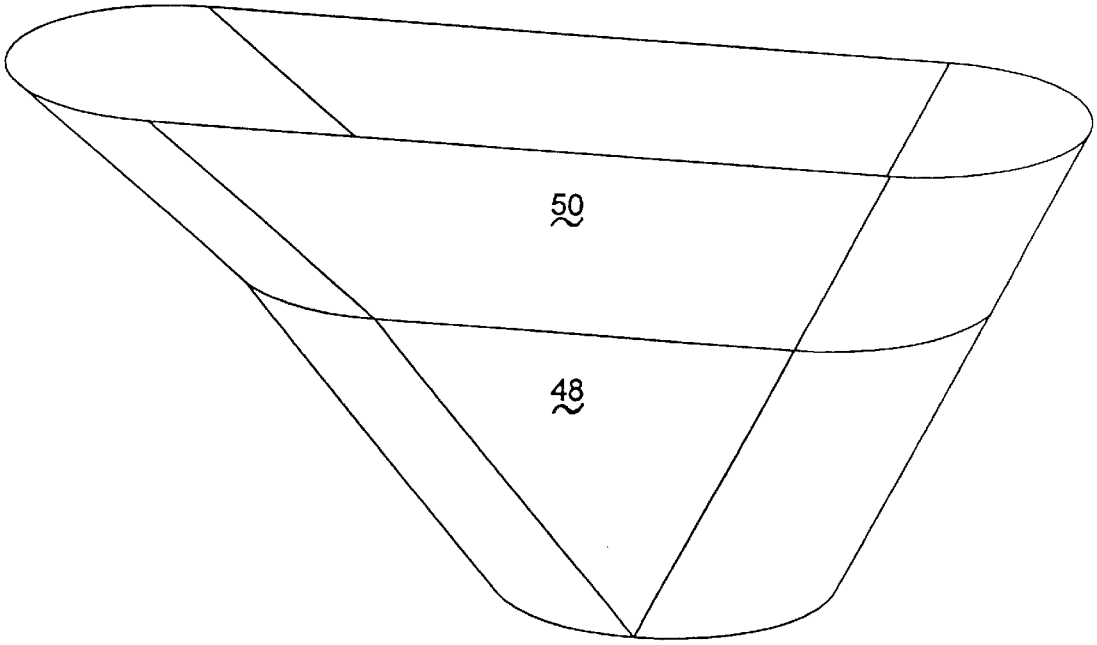
FIG. 10 is a diagram showing an offset one dimensional convergence hopper in accordance with the present invention; and, FIG. 11 is a diagram showing an offset wedge-shaped hopper in accordance with the present invention.
Figure 11:
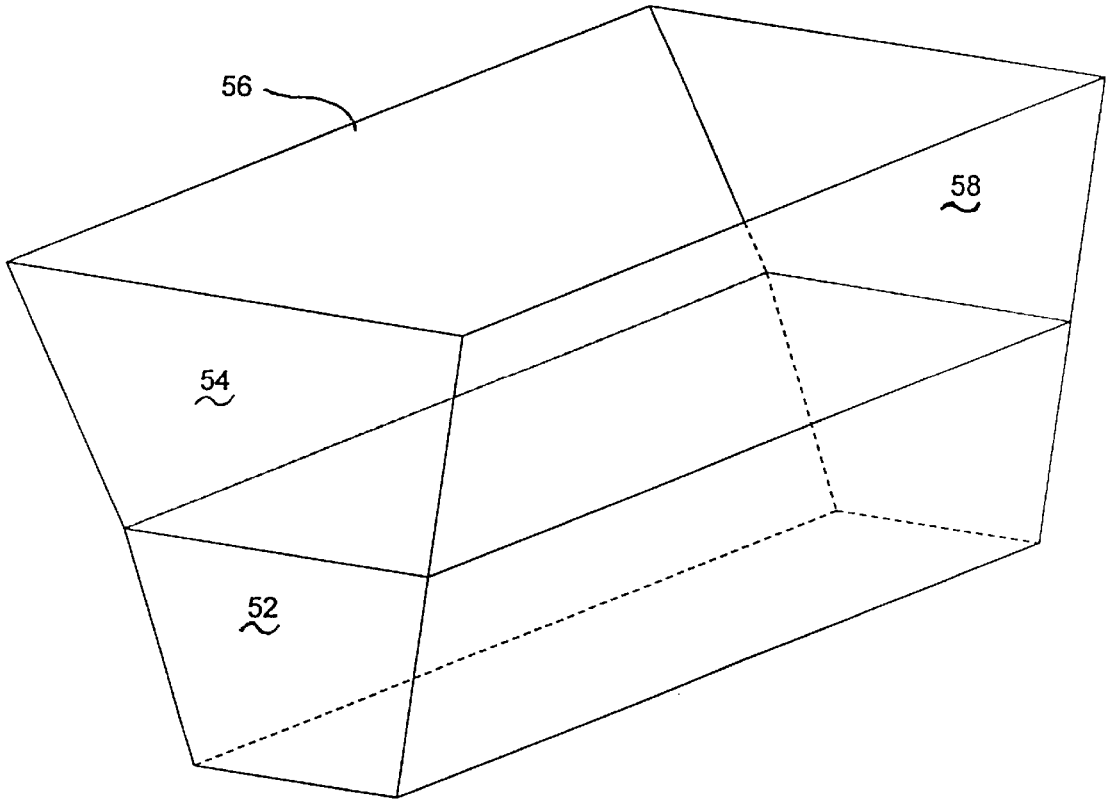

Typical applications of the invention include:

a) The conical hopper (FIG. 4) where the similar cross sections are circular and arranged symmetrically around a common vertical centerline.

b) The wedge-shaped hopper (FIG. 5) where the similar cross sections are rectangular and arranged symmetrically about a vertical centerline.

c) The one-dimensional convergence hopper, reference U.S. Pat. No. 4,958,741 (FIG. 6) with similar cross sections composed of a rectangle with semi-circular ends, with the diameter of the semi-circular ends equal or decreasing slightly in the upward direction and the entire cross section arranged symmetrically about a vertical centerline.

d) The chisel-shaped hopper, reference U.S. Pat. No. 4,958,741 (FIG. 7) composed of similar cross sections composed of a rectangular central portion and semi-circular ends, with the semi-circular ends arranged so that their outer extremities lie in a vertical line or a line slightly diverging downward.

e) The combination of c) and d), reference U.S. Pat. No. 4,958,741.

f) The conical chisel and one-dimensional convergence hopper shown in FIG. 8.

g) The offset conical hopper (FIG. 9) in which the similar circular cross sections are not symmetric about a vertical axis. In FIG. 9, the walls of the hopper segments 42, 44 and 46 are inclined from the vertical by angles that range from $\theta_{1\,MIN}$ to $\theta_{1\,MAX}$ for the lowest segment 42, from $\theta_{2\,MIN}$ to $\theta_{2\,MAX}$ for the next highest segment 44, and from $\theta_{3\,MIN}$ to $\theta_{3\,MAX}$ for the upper segment 46.

h) The offset one-dimensional convergence hopper (FIG. 10) in which the essentially vertical parallel side walls 48 and 50 are arranged above each other but the semi-circular end walls are not symmetrically arranged about a vertical axis.

i) The offset wedge-shaped hopper (FIG. 11) in which the end walls 52 and 54 are still vertical but the sides 56 and 58 are not symmetric about a vertical axis.

I claim:

1. A hopper that eliminates bridging of a particulate material it contains, comprising:

an outlet;

a wall extending upward from said outlet and including a plurality of sections, each section joined to the next-lower section and inclined at a less steep angle of inclination with respect to horizontal than the adjoining next-lower section, wherein the angles of inclination of said plurality of sections are such as to satisfy the equations $$\oint \sigma_n(\text{Tan}\ \theta+\mu)dp=\oint \gamma dA$$

where $\sigma_n$ is stress perpendicular to the wall of the hopper, $\theta$ is the inclination of the hopper wall with respect to vertical, $\mu$ is coefficient of friction between the wall and the particulate material, and $\gamma$ is the bulk specific weight of the particulate material, and $$\sigma_n=fc/(\mu^2+1)$$

where $f_c$ is the unconfined yield stress of the particulate material, and $\mu$ is the coefficient of friction between the wall and the particulate material.

2. The hopper of claim 1 wherein the hopper is a one-dimensional convergence hopper and wherein the angles of inclination of said plurality of sections satisfy the following equation $$L/w=0.342\pi(\text{Tan}\ \theta_1-\text{Tan}\ \theta)/(1.368\ \text{Tan}\ \theta_1+1.6\mu)$$

where for each section

L is the length of the straight portion at the top of the section,

W is the width of the outlet of the section, $\theta_1$ is the inclination of the hopperwall with respect to vertical for the section, $\Theta_2$ is the inclination of the hopper wall with respect to vertical for the next-higher section, and $\mu$ is the coefficient of friction between the wall and the particulate material.

3. The hopper of claim 1 wherein the hopper is a one-dimensional convergence hopper and wherein for each section the angle of inclination $\theta$ of the hopper wall with respect to the vertical is given by the following equation $$\text{Tan}\ \theta=(y(\pi w/4+L)(\mu^2+1)/(\pi f_c)-0.1\ \mu L(\pi w)\ -0.425\mu)/0.342$$

where for each section $\gamma$ is the bulk specific weight of the particulate material, W is the width of the outlet of the section, L is the length of the straight portion at the top of the section, $\mu$ is the coefficient of friction between the wall and the particulate material, and $f_c$ is the unconfined yield stress of the particulate material.

4. The hopper of claim 1 wherein the hopper includes an upper chisel portion and a lower one-dimensional convergence portion and wherein the angles of inclination of said plurality of sections in said upper chisel portion satisfy the following equation $$\text{Tan}\ \theta_2=(B_2/B_1)(\text{Tan}\ \theta_1+\mu)-\mu$$

where for each section $\theta_1$ is the inclination of the hopper wall with respect to vertical for the section, $B_1$ is the outlet size for the section, $\theta_2$ is the inclination of the hopper wall with respect to vertical for the next-higher section, $B_2$ is the outlet size for the bottom of the next-higher section, and $\mu$ is the coefficient of friction between the wall and the particulate material, and the angles of inclination of said plurality of sections in the lower one-dimensional convergence portion satisfy the following equation, $$L/w=0.342\pi(\text{Tan}\ \theta_1-\text{Tan}\ \theta)/(1.368\ \text{Tan}\ \theta_1+1.6\mu)$$

where for each section

L is the length of the outlet of the straight portion at the top of the section, W is the width of the outlet of the section, $\theta_1$ is the inclination of the hopper wall with respect to vertical for the section, $\Theta_2$ is the inclination of the hopper wall with respect to vertical for the next-higher section, and $\mu$ is the coefficient of friction between the wall and the particulate material.

5. The hopper of claim 1 wherein the hopper includes an upper chisel portion and a lower one-dimensional convergence portion and wherein for each section of said upper chisel portion the angle of inclination θ of the hopper wall with respect to the vertical is given by the following equation $$\text{Tan}\ \theta = y(A/P)(\mu^2+1)/fc-\mu$$

where for each section

γ is the bulk specific weight of the particulate material,

A is the area of the outlet of the section,

P is the periphery of the outlet of the section, $\mu$ is the coefficient of friction between the wall and the particulate material, and $f_c$ is the unconfined yield stress of the particulate material, and wherein for each section of said lower one-dimensional convergence portion the angle of inclination θ of the hopper wall with respect to the vertical is given by the following equation $$\text{Tan}\ \theta = (y(\pi w/4+L)(u^2+1)/(\pi f_c)-0.1\ \mu L(\pi w)\ -0.425\mu)/0.342$$

where for each section

γ is the bulk specific weight of the particulate material,

W is the width of the outlet of the section,

L is the length of the straight portion at the top of the section, $\mu$ is the coefficient of friction between the wall and the particulate material, and $f_c$ is the unconfined yield stress of the particulate material.

6. The hopper of claim 1 wherein the hopper is an offset one-dimensional hopper and wherein each of said plurality of sections includes a maximum angle of inclination and a minimum angle of inclination which when averaged define an average angle of inclination for each section, and wherein the average angles of inclination of said plurality of sections satisfy the following equation, $$L/w = 0.342\pi(\text{Tan}\ \theta_1 - \text{Tan}\ \theta)/(1.368\ \text{Tan}\ \theta_1 + 1.6\mu)$$

where for each section

L is the length of the straight portion at the top of the section,

W is the width of the outlet of the section, $\theta_1$ is the average inclination of the hopper wall with respect to vertical for the section, $\Theta_2$ is the average inclination of the hopper wall with respect to vertical for the next-higher section, and $\mu$ is the coefficient of friction between the wall and the particulate material.

* * * * *